US006081241A

United States Patent [19]

Josefsson et al.

[11] Patent Number: 6,081,241

[45] Date of Patent: Jun. 27, 2000

[54] MICROWAVE ANTENNA TRANSMISSION DEVICE HAVING A STRIPLINE TO WAVEGUIDE TRANSITION VIA A SLOT COUPLING

[75] Inventors: Lars Gustaf Josefsson, Askim; Mats Gunnar Håkan Eriksson, Göteborg; Lars Bertil Malm, Mölndal; Jan Michael Bergendahl, Mölnlycke, all of Sweden

[73] Assignee: Telefonaktiebolaget LM Ericsson, Stockholm, Sweden

[21] Appl. No.: 09/083,502

[22] Filed: May 22, 1998

[30] Foreign Application Priority Data

May 26, 1997 [SE] Sweden ..... 9701961
Mar. 27, 1998 [SE] Sweden ..... 9801071

[51] Int. Cl.[7] ..... H01Q 13/10; H01P 5/107

[52] U.S. Cl. ..... 343/771; 333/26

[58] Field of Search ..... 333/26, 33; 343/771, 343/776, 24 R

[56] References Cited

U.S. PATENT DOCUMENTS

| | | | |
|---|---|---|---|
| 2,939,093 | 5/1960 | Marie | 333/110 |
| 2,976,499 | 3/1961 | Sferrezza | 333/33 X |
| 3,708,767 | 1/1973 | Moore | 333/24 R |
| 5,028,891 | 7/1991 | Lagerlöf | 333/26 |
| 5,414,394 | 5/1995 | Gamand et al. | 333/26 |
| 5,539,361 | 7/1996 | Davidovitz | 333/26 |

FOREIGN PATENT DOCUMENTS

| | | | |
|---|---|---|---|
| 0747994A2 | 11/1996 | European Pat. Off. . | |
| 195 18 032 | 11/1996 | Germany . | |
| 153802 | 11/1981 | Japan | 333/26 |
| 4109702 | 4/1992 | Japan | 333/26 |

OTHER PUBLICATIONS

Jonas Flodin, "Optimization of the Feeding of a Waveguide Slot Antenna, for a Given Frequency and Scan Angle Band", Antenna 1997, May 27–29, 1997, Gothenburg, Sweden, pp. 135–141.

*Primary Examiner*—Benny T. Lee
*Attorney, Agent, or Firm*—Burns, Doane, Swecker & Mathis, L.L.P.

[57] ABSTRACT

A device for the power transmission of microwaves between a strip-line and a number of parallel cavity waveguides arranged in a group antenna. The strip-line includes H-shaped slots. These slots are centered with respect to a central conductor. Opposite each of the slots, a corresponding slot is arranged through the wall of the cavity waveguide. Electrically conducting seals are arranged to follow immediately outside the contours of the slots. The strip-line is fixedly fastened to the seals and the ridge waveguide, whereby good electrical coupling is achieved. Simultaneously, small cavities are formed between the slots. These cavities have a leveling effect such that the demands on mechanical precision is appreciably lowered, such that the tolerance to placement of the slots opposite to each other is increased substantially as compared to the case of the waveguides directly abutting the strip-line.

30 Claims, 5 Drawing Sheets

MICROWAVE ANTENNA TRANSMISSION DEVICE HAVING A STRIPLINE TO WAVEGUIDE TRANSITION VIA A SLOT COUPLING

TECHNICAL FIELD

The invention concerns devices for power transmission between two transmission conductor devices for electromagnetic microwaves, such as a cavity waveguide and a strip-line, via radiation slots. The invention also concerns a microwave antenna coupled by means of such devices.

BACKGROUND AND PRIOR ART

Group antennas for microwaves comprising a desired number of parallel cavity waveguides are known. The cavity waveguides are thereby placed adjacent to each other and on the front sides of the cavity waveguides, a great number of short slots are arranged one after the other, through which microwave energy is emitted to and/or is taken up from the surroundings. The slots are normally evenly spaced along the cavity waveguides. The cavity waveguides may according to a suitable point of view be looked upon as resonance chambers, from which microwaves may be emitted through said slots.

In U.S. Pat. No. 5,028,891 an antenna of this type is described, in which the cavity waveguides, which preferably are comprised of ridge waveguides are fed via a number of adaptation chambers in which a central conductor is arranged in a substrate. Each adaptation chamber is fed by a coaxial cable and is arranged in direct communication with one of the cavity waveguides in such a way that one of the walls of the same is formed by one of the walls of the cavity waveguide. In this wall a preferably H-shaped slot is arranged through which microwaves are transmitted from the adaptation chamber to the cavity waveguide.

The construction described in U.S. Pat. No. 5,028,891 having adaptation chambers is, however, expensive and relatively complex. High demands are for instance made on the adaptation chamber fitting tightly against the cavity waveguide. Each adaptation chamber for the group antenna needs individual mounting and adjustment with small tolerances.

The shown construction also demands relatively much space depthwise, which presents a substantial drawback in antenna constructions where the available space often constitutes a limiting factor. This fact is accentuated in mobile applications.

Power transmission of microwaves between different transmission conductor devices using slots is also known in other contexts. U.S. Pat. No. 5,539,361 shows a transition section between a cavity waveguide and a microstrip conductor. The cavity waveguide exhibits a continuously tapering form up to an aperture around which the cavity waveguide preferably is tightly applied to an earth plane on the microstrip card. A slot is arranged in the earth plane opposite this aperture. This slot is the same size or smaller than the aperture in the cavity waveguide. The cavity waveguide is adapted to transmit microwaves in its longitudinal direction up to the aperture. As the slot is small in comparison to the cross-section of the cavity waveguide reflections tend to arise. To try to counteract this effect the cavity waveguide exhibits a slowly tapering cross-section.

Also for the construction described in this document it is true that much care is required to accomplish a tight transition in order to avoid power losses. Further, this construction is sensitive to a possible displacement of the aperture in relation to the slot in the earth plane. This is especially so, when the aperture is approximately as big as the slot. If the slot is smaller than the aperture, problems arise with reflections giving less efficiency.

SUMMARY OF THE INVENTION

As is mentioned above, it is desirable to achieve a device for power transmission of electromagnetic microwaves between a first and a second transmission conductor device, e.g. a cavity waveguide and a strip-line in which high efficiency may be combined with low complexity and small requirements as to space. Especially desirable is the possibility to achieve a power transmission device for antennas where the antenna elements are constituted by cavity waveguides, in which high efficiency may be combined with low complexity and small requirements as to space, especially depthwise, without the requirements on the mechanical precision becoming too great. It has earlier been a problem to fulfil these requirements.

The present invention solves this problem by arranging said first transmission conductor device and the second transmission conductor device adjacent to each other in such a way that the first transmission conductor device is delimited or bounded in the direction of the second transmission conductor device by a first electrically conducting wall, and the second transmission conductor device is delimited or bounded in the direction of said first transmission conductor device by a second electrically conducting wall. To accomplish this, a first radiation slot in the first electrically conducting wall and a second radiation slot in the second electrically conducting wall are used for the power transmission, whereat the first electrically conducting wall belongs to the first transmission conductor device and the second electrically conducting wall belongs to the second transmission conductor device. These two radiation slots exhibit essentially the same form and elongation, and are arranged adjacent and essentially opposite each other. An electrically conducting sealing means is arranged in electrical contact with said first electrically conducting wall and that the second electrically conducting wall, around said first and second radiation slots such that a electrically essentially closed cavity (10) from the environment is created between said first and said second wall, through which cavity the microwave effect may be transmitted.

Said first transmission conduction device preferably consists of a cavity waveguide, such as a ridge waveguide in a group antenna. The second transmission conduction device is arranged adjacent to the first transmission conduction device in such a way that the electrically conducting walls are essentially plane-parallel, and the slots arranged essentially opposite each other. Two adjacent, cooperating slots implicitly demands an exact centering of the slots in order to achieve good efficiency. This effect is, however, counteracted by the electrically conducting sealing means, which abuts both the first and the second electrically conducting wall such that a substantially, towards the environment, electrically sealed cavity is created between said first and said second transmission conduction devices. This cavity has a levelling effect, such that the demands on the mechanical precision is considerably lowered. The cavity is preferably small in comparison to the transmission conduction device and in comparison with the wavelength of the microwaves.

One object of the present invention is to achieve a device for power transmission of electromagnetic microwaves between a first transmission conduction device and a second transmission conduction device in which high efficiency may be combined with low complexity and small demands on space.

Another object of the invention is the possibility to achieve a device for power transmission in microwave antennas, preferably group antennas, where the antenna elements are achieved by means of cavity waveguides, in which high efficiency may be combined with low complexity, moderate demands on mechanical precision and small demands on space, especially depthwise.

One advantage of the present invention is that a device for power transmission of electromagnetic microwaves between a first transmission conduction device and a second transmission conduction device is achieved in which high efficiency may be combined with good bandwidth and small demands on space.

Another advantage of the present invention is the possibility to achieve a device for power transmission of electromagnetic microwaves to and/or from group antennas, which is adapted to mobile applications where strict space requirements are required.

A further advantage of the present invention is the possibility to achieve a device for power transmission of electromagnetic microwaves between a first transmission conductor device and a second transmission conductor device, in which the mutual relationship of all elements demands high mechanical precision, may be realized in one and the same building element, thus all these demands may be fulfilled without difficulty.

Yet another advantage of the present invention is the possibility to achieve a device for power transmission for microwave group antennas, in which the antenna elements are achieved by means of a cavity waveguide, wherein one and the same transmission conductor device, e.g. being a strip-line card, may be used for power transmission to and from several of the cavity waveguides comprised in the antenna.

The invention will be further explained below in connection with embodiments of the invention with reference to the attached drawings in which like reference numerals reference like elements throughout the different drawing figures.

PREFERRED EMBODIMENTS

Figure 1A:
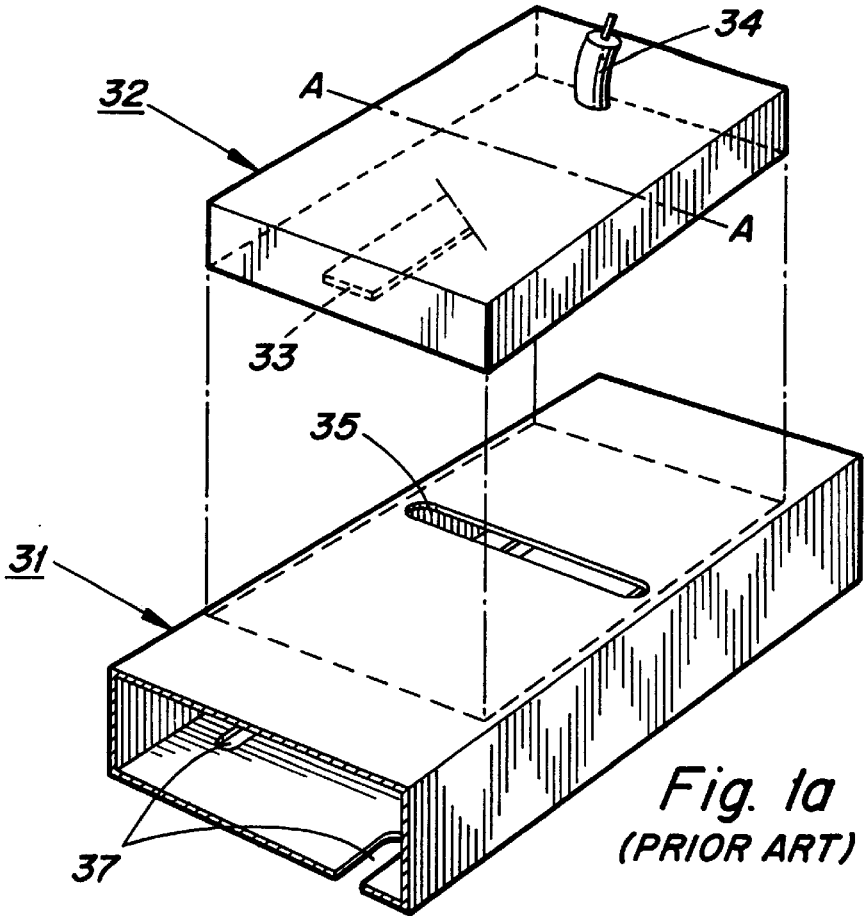
Fig. 1a (PRIOR ART)
FIG. 1*a* is a perspective view of a known device for power transmission.
Figure 1B:
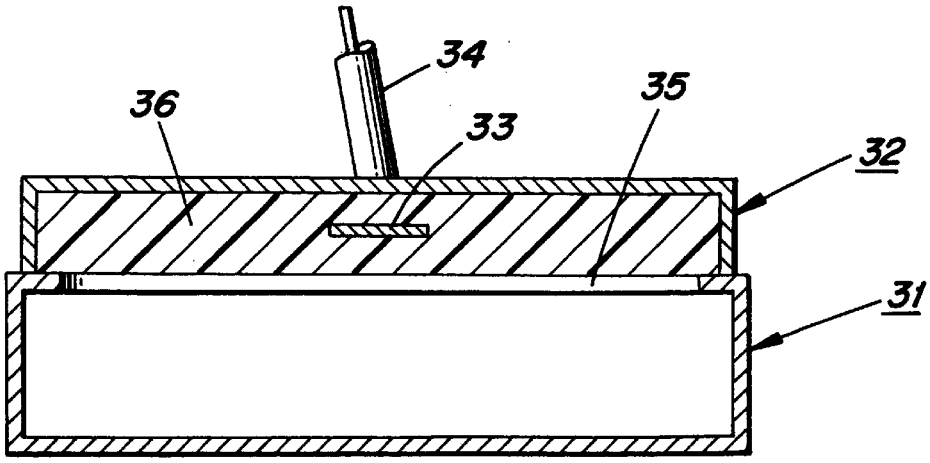
Fig. 1b (PRIOR ART)
FIG. 1*b* is a cross-section of the known device as shown in FIG. 1*a*.

FIG. 1 a shows a cavity waveguide for microwaves as described in U.S. Pat. No. 5,028,891. The cavity waveguide designated 31 is formed of electrically conduction material and exhibits a rectangular cross-section. The cavity waveguide designated 31 supports an adaptation chamber 32 which is coupled to a coaxial conductor 34 having a rotationally symmetric cross-section. The cavity waveguide 31 has on its front side a set of slots 37, through which microwave energy may radiate to the environment. The adaptation chamber 32 is built around a dielectric substrate 36 (See FIG. 1*b*). This substrate is on five of its six sides surrounded by electrically conducting walls. The sixth side of the substrate 36 abuts the side of the cavity waveguide 31 which is opposite to the side having said set of slots 37. Centrally in the substrate a central conductor 33 arranged in the longitudinal direction of the cavity waveguide. The wall of the cavity waveguide abutting the adap-tation chamber 32 is provided with a resonance slot 35, which is arranged perpendicularly to the longitudinal direction of the cavity waveguide. Via this resonance slot 35 the microwave energy in the adaptation chamber 32 is coupled to the cavity waveguide 31.

FIG. 1*b* shows a cross-section A—A through cavity waveguide 31 and the adaptation chamber 32 in FIG. 1*a*. Here may be seen that while the substrate 36 in the adaptation circuit on all sides but one is surrounded by conducting walls, the substrate directly abuts the cavity waveguide 31, whereby the wall of the cavity waveguide is used as a sixth delimiting wall for the adaptation chamber 32. The adaptation chamber is used as a resonance chamber. By means of the central conductor an electromagnetic wave is generated in the adaptation chamber 32, which via the resonance slot 35, is coupled to the cavity waveguide 31.

The construction described in U.S. Pat. No 5,028,891, having an adaptation chamber feed via a coaxial conductor is expensive and exhibits a rather high complexity. Every adaptation chamber demands individual mounting and adjustment using small tolerances. High demands are in this respect made upon the adaptation chamber walls being tightly fitted to the wall of the cavity waveguide in order to keep the effect losses down. The coaxial coupling also leads to the adaptation chamber demanding a rather big space depthwise. In the construction of microwave group antennas the available space is often a limiting factor. Especially considering a mobile antenna, such as an antenna mounted in an aircraft for mobile reconnaissance radar, the demands on space, especially depthwise, is a critical factor.

In the present invention the power transmission to and from a cavity waveguide is accomplished using a strip-line arranged in the orthogonal direction as related to the power transmission direction in direct connection to the top face of a cavity waveguide. Hereby the space demands depthwise are considerably reduced since the coaxial connection can totally be left out. Further this construction makes it possible to arrange, in one strip-line card, several power transmission devices, arranged parallel to each other, for several cavity waveguides, e.g. to all cavity waveguides in a group antenna.

However, at the same time new problems arise. The topside of the cavity waveguide and the earth plane which is situated on the underside of said strip-line adjacent to the cavity waveguide must fit tightly to each other in order to avoid power losses. Further, in this construction there must be a radiation slot in both the strip-line, the earth plane and the cavity waveguide. The position of these slots, must for good efficiency, be adapted to each other with a high degree of accuracy and repeatability. This leads to very high demands on tolerance, i.e. permissible variations, especially if the same strip-line card is used for several adjacently arranged cavity waveguides. This tends to lead to unreasonably high costs.

In the present invention this is solved by an electrically conducting sealing device between the waveguides around the slots, whereby good isolation is guaranteed. This sealing device is arranged according to the invention such that a small cavity is formed between the two transmission conduction devices. This cavity has a levelling effect such that a device having good transmission characteristics is obtained, without high demands on mechanical precision in relation to the transmission conduction devices and the slots.

However, it is essential that symmetry is achieved between the strip-line guide and the slot in the earth plane which is associated with this strip-line guide. It is further important to achieve a well-defined distance between the slot and the strip-line guide. This distance determines the transition impedance. By using a slot in the earth plane of the strip-line card, this slot and the strip-line guide will be found in the same structure, whereby a desired positioning of this slot in relation to the guide may be accomplished without problems.

Figure 2A:
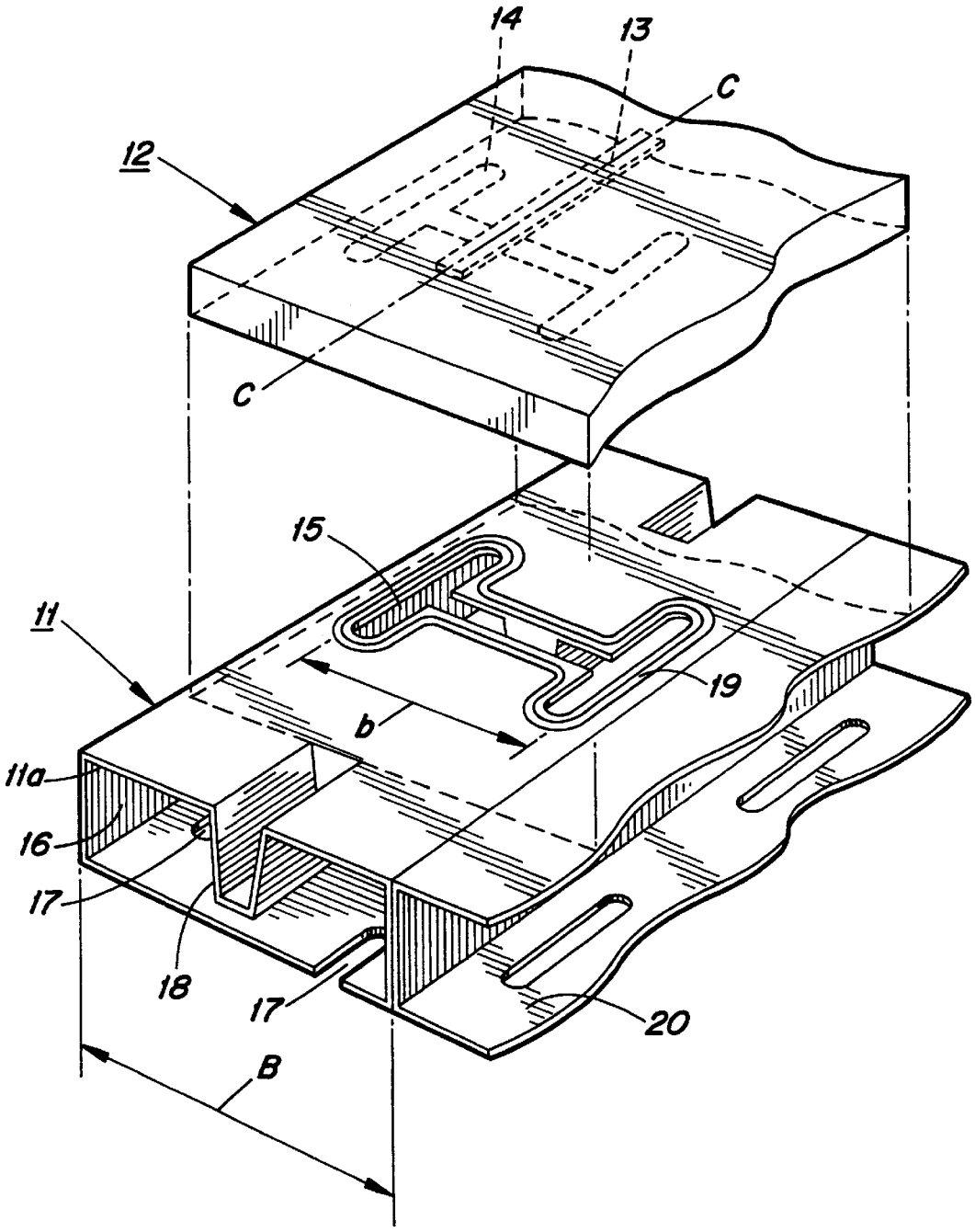
FIG. 2*a* is a perspective view of a preferred embodiment of the invention.

FIG. 2*a* shows a perspective view of a preferred embodiment of the invention. A strip-line 12 is arranged to transmit microwave signals, in this case in the frequency band 3 to 3.5 GHz, to and/or from a number of essentially identical ridge waveguides being part of a group antenna. One of these waveguides denoted 11 is shown in FIG. 2*a*. In the Figure is also shown in outline an adjacent ridge waveguide 20. The ridge waveguide 11 is equipped with a ridge 18 along one of its sides, said ridge protruding into the waveguide and extending in the longitudinal direction of the waveguide.

The ridge waveguide has the advantage of allowing a relatively broad bandwidth in the fundamental mode of a microwave which propagates in the waveguide. The ridge waveguide also has the advantage of having a width B which is relatively small in comparison to the wave-length $\lambda$ of the microwave, e.g. of the size $B=0.4\cdot\lambda$, which may be compared to a known rule of thumb stating that in order to avoid the appearance of grid lobes for a group antenna, $d<\mu/2$, wherein d designates the distance between two adjacent antenna elements. These characteristics may be used with the above mentioned type of group antennas, which have many parallel waveguides closely adjacent each other. By using the relatively small width it is possible to achieve phased microwave antennas according to known technology.

Figure 2B:
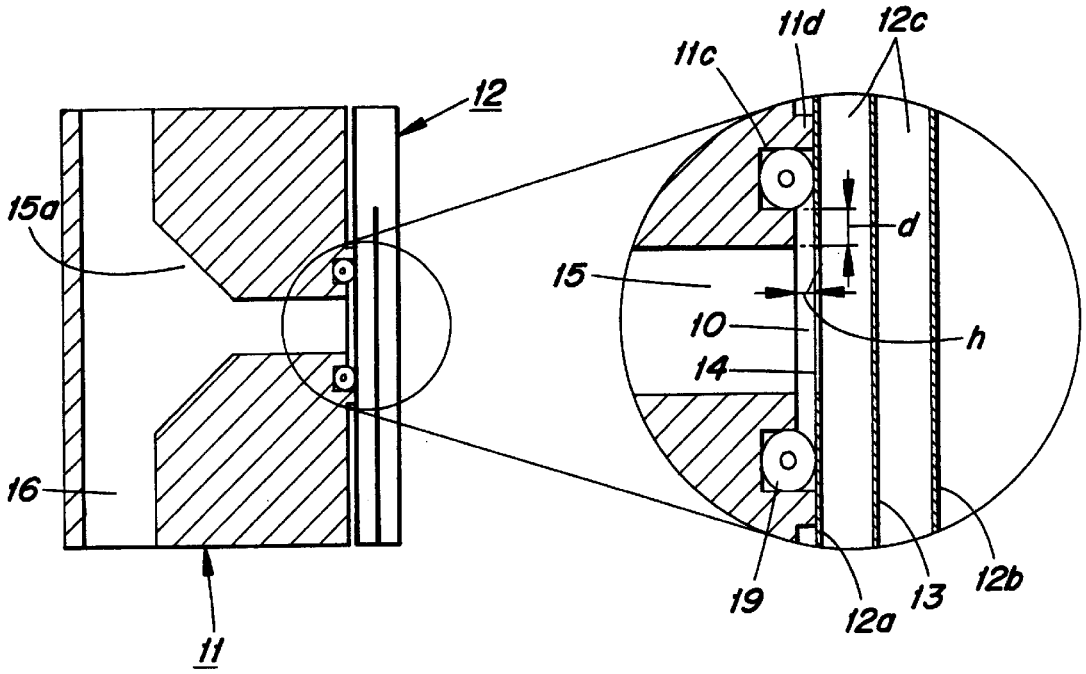
FIG. 2*b* is a cross-section through the embodiment shown in FIG. 2*a*.

FIG. 2*b* is a sectional view through said strip-line 12 along a plane which is shown by the line C—C in FIG. 2*a*. This strip-line 12 is equipped with an upper earth plane 12*b* and a bottom earth plane 12*a*. Between these two earth planes an electrically isolating substrate 12*c* is arranged. In the substrate, on a well-defined distance from the earth planes 12*a* and 12*b*, a central conductor 13 is arranged. In this example the central conductor is arranged in the middle between the two earth planes. The earth plane 12*a* facing towards the ridge waveguide 11 is provided with a H-shaped slot 14. H-shaped slots are especially well adapted in such cases in which the wavelength of the signal is large relative to the maximum length of the slot. The H-shaped slot 14, which in this example is produced through etching, is arranged centered in relation to the central conductor 13. The slot has in this example a width b (See FIG. 2*a*) of approximately 32 mm and the width B (See FIG. 2*a*) of the waveguide 11 is approximately 43 mm. Right opposite this slot 14 is a corresponding second H-shaped slot 15 arranged, as shown in FIG. 2*a*, through the wall 11*a* of the ridge waveguide on the side where the ridge 18 is arranged. The ridge 18 may, from one standpoint, be looked upon as a fold protruding into the cavity waveguide. Looked upon from the outside of the cavity waveguide 11, the ridge 18 appears as a longitudinal recess in the waveguide. As can be seen from FIG. 2*a*, this recess is filled with a conducting material, on a level with the slots 14, 15.

As shown in FIG. 2*b*, an electrically conducting seal 19 is arranged in a groove 11*c* in the outer wall 11*a* of the ridge waveguide. The seal 19 is in this example of the type O-ring seal and is made from silicon rubber with a coating of silver-plated aluminium spheres vulcanized onto it. The seal is adapted to follow immediately outside the contours of the slots, as shown by a distance d in FIG. 2*b*. As outlined in FIG. 2*b*, the seal 19 in this example is hollow. Hereby swelling of the seal at compression is counteracted. In this example the distance d between the outer contours of the slots and the seal is approximately 1 mm. Outside the groove 11*c*, a flange 11*d* is arranged directly adjacent the groove with an associated seal 19. The flange 11*d* has in this example a height h of 0.5 mm and runs, as does the groove 11*c*, around the whole slot 15. However, it is not necessary that the flange runs around the whole slot. The flange may also be interrupted or solely support the strip-line card in a limited number of points. Another conceivable possibility is to arrange the seal 19 outside the flange 11*c*.

The strip-line 12 is fixed to the seal 19 and the ridge waveguide 11 by means of fixing devices, which in this example consist of a number of screws (not shown in the figure).

Around these screws the waveguide is provided with flanges of the same type and the same height as the flange 11*d*. Said strip-line 12 will hereby be pressed against the elastic seal 19 whereby the seal is hermetically tight to the environment, and a good electrical coupling is guaranteed between the strip-line-earth plane 12*a* and the ridge waveguide wall 11*a*. Hereby the risk of airgaps being formed between the two transmission conduction devices and possible leakage, is essentially removed. The strip-line 12 will in this case bear upon the flange 11*d* and also upon the flanges surrounding the screws. Hereby a small cavity 10 between said strip-line 12 and the cavity waveguide 11 is formed. The height of the cavity will then be decided by the height of the flanges, which in this case is h=0.5 mm. Its extension in the two other dimensions is delimited by the seal 19.

Figure 2C:
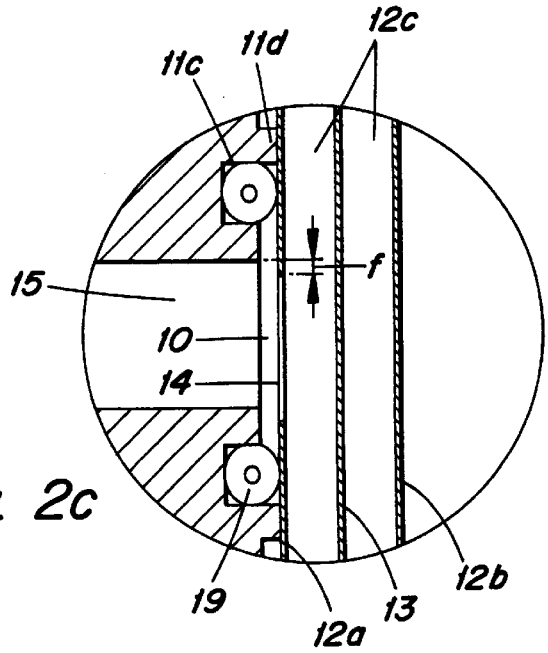
FIG. 2*c* is a cross-section illustrating a relative displacement of two elements in the embodiment of the invention as shown in FIGS. 2*a* and 2*b*.

The cavity 10 has a levelling effect. Thereby the demands on the mechanical precision is decreased so that the tolerance towards the placement of the slots in relation to each other is essentially increased as compared to the case wherein the strip-line-earth plane would directly abut the cavity waveguide. The slots 14 and 15 may be allowed to be displaced up to 1 mm relative to each other in longitudinal and/or lateral direction without detrimental effect on the power transmission. One example of such a displacement is shown in FIG. 2*c*, which shows the cross-section of FIG. 2*b* through the cavity 10. The displacement is shown in the longitudinal direction of the ridge waveguide 11 by a distance f. In the same way it is possible to let the central conductor 13 be displaced approximately ½ mm askew relative to the slot 15 in the cavity waveguide. Put in relation to the width b of the slots being approximately 30 mm and the conductor width of the strip-line, i.e. 1.92 mm, this implies very low tolerance demands. The height of the cavity 10 is, as mentioned above, 0.5 mm in this embodiment of the invention. For achieving the best power transmission of microwave signals in the frequency range of this example, the height h should preferably be chosen between approximately 0.3 and 1.0 mm.

FIG. 2*b* shows how the above mentioned slot 15 in the ridge waveguide wall has been broadened in the longitudinal direction of the ridge waveguide into a tunnel-shape. This tunnel-shape, however, is only formed in the filled-up ridge 18. As can be seen more clearly in FIG. 2*a*, the ridge waveguide slot 15 also extends on both sides of the ridge. Here the slot is characterized by a simple opening in the wall of the waveguide.

In the above described embodiment of the present invention a power transmission is shown between a strip-line card and an essentially rectangular cavity waveguide. The invention can also be realized using a cavity waveguide having a circular cross-section, or using completely different combinations of transmission conductor devices where these may be so arranged that they are delimited toward each other by electrically conducting and essentially plane-parallel walls. An example of this is a cavity waveguide-to-cavity waveguide transition, a strip-line-to-strip-line transition, where one or both of these strip-lines may even be made using microstrip technique, or a strip-line-to-coaxial conductor transition.

Figure 3:
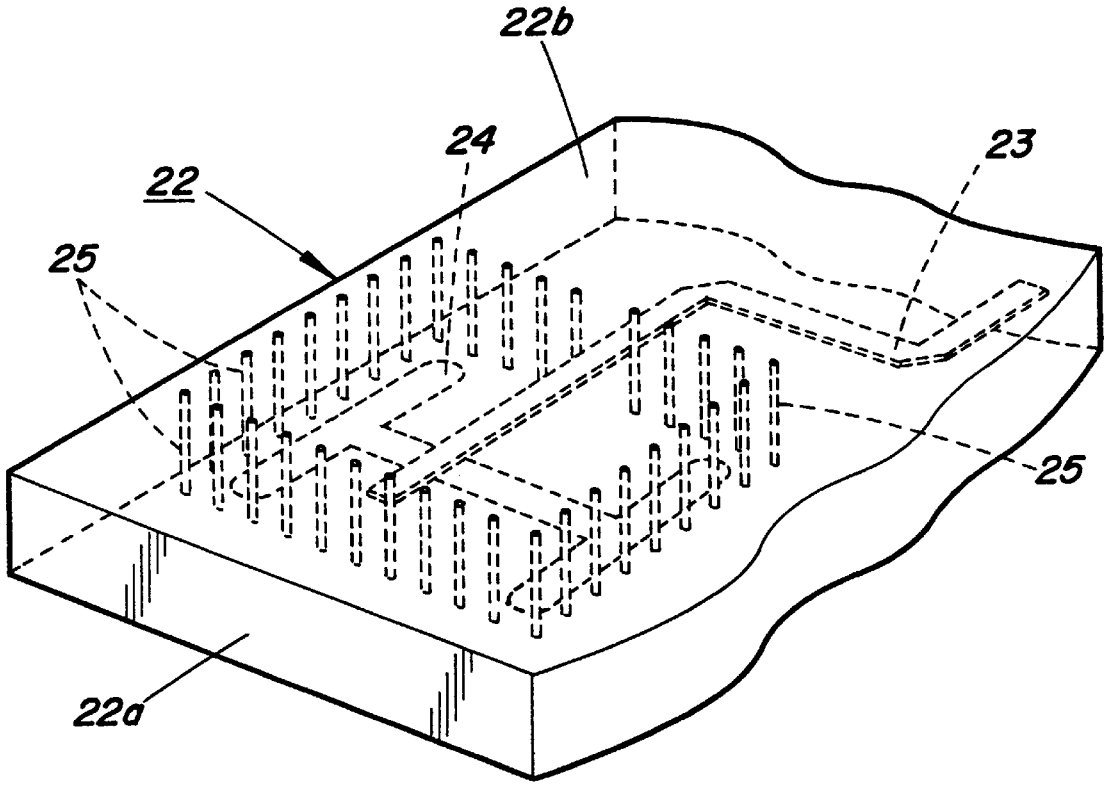
FIG. 3 is a perspective view of a detail according to an alternative embodiment to the one shown in FIGS. 2*a* and 2*b*.

FIG. 3 is a perspective view of an alternative embodiment of said strip-line 12 in FIGS. 2*a* and 2*b*. This strip-line, here denoted 22, is according to prior art per se equipped with an upper earth plane 22*b* and a bottom earth plane 22*a*. The bottom earth plane is equipped with an H-shaped slot 24. A number of through-plated holes 25 connecting the upper and the bottom earth plane 22*b*,22*a* are arranged along the sides of an imaginary rectangle, essentially symmetrically around the slot 24. The distance between these through-plated holes is small compared to the microwave wavelength λ. In said strip-line substrate a central conductor 23 is arranged. It is arranged to pass between two adjacent through-plated holes and to extend in the longitudinal direction of the cavity waveguide past the center of the slot 24.

In the transmission conduction transition, there occurs a transition from a transversal electromagnetic wave (TEM), coming into said strip-line, to a transversal electric wave (TE) in the cavity waveguide According to a strongly simplified view the TEM-wave sees the slot 24 as an unsymmetrical interference, which causes TE-waves to arise. As these are not bound to the central conductor in the same way as the TEM-wave, part of the microwave power could show a tendency to propagate freely through the strip-line substrate. This phenomenon is counteracted by the through-plated holes 25 which, somewhat simplified, can be said to form an earthed cage around the slot 24.

Owing to the fact that one and the same strip-line card may be connected to several adjacent cavity waveguides at the same time, where the power transmission preferably is executed at several locations of the same cavity waveguide, the invention offers a mechanically simple construction for power transmission in a group antenna constituted by cavity waveguides. Preferably the strip-line card comprises at least a distribution network, by which the power is distributed to the several slots-transitions. Preferably other components, such as impedance attenuation circuits and filters may advantageously be integrated on the strip-line card according to known technique.

Figure 4:
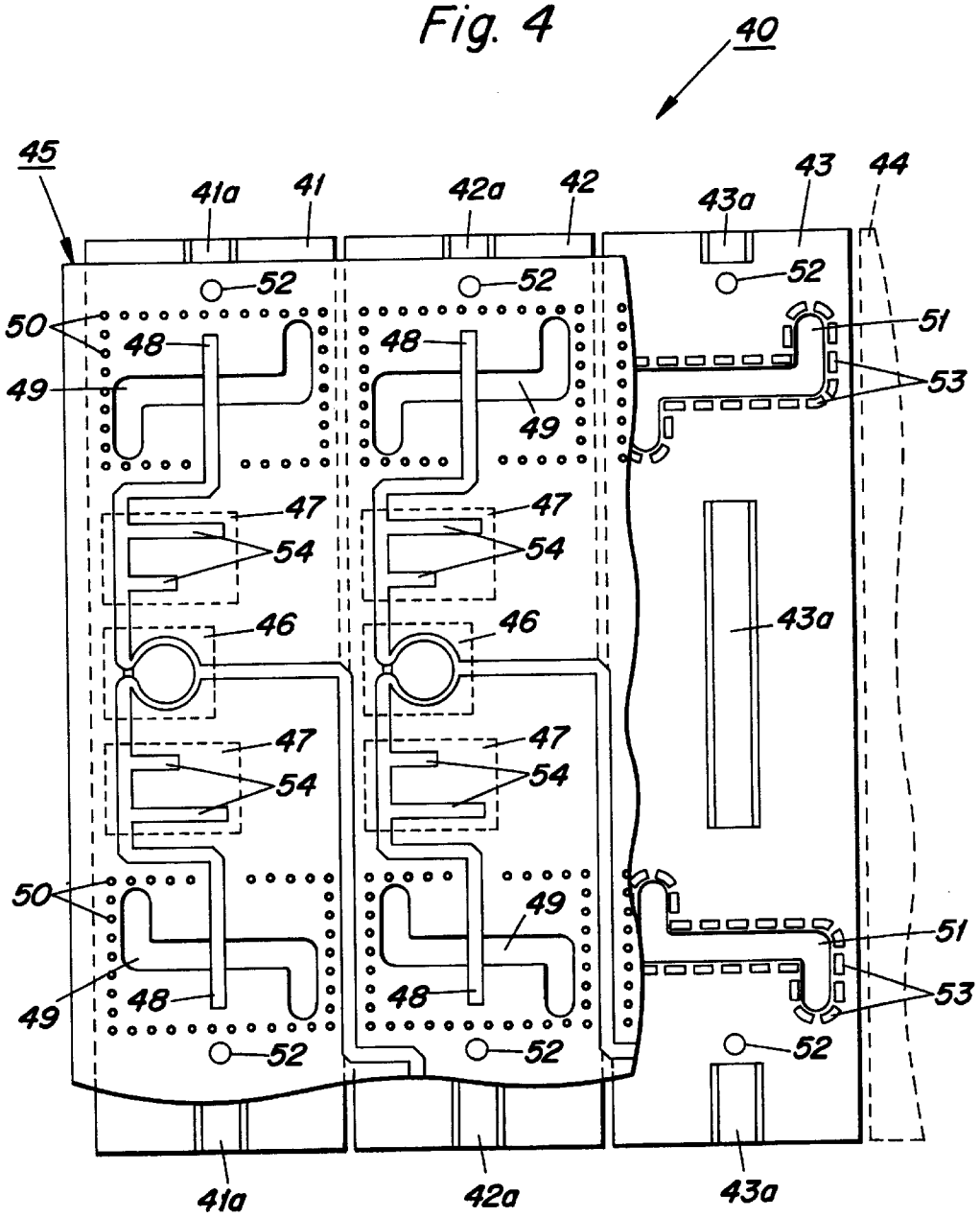
FIG. 4 is a view of an antenna device according to the present invention.

FIG. 4 shows an over-arching and somewhat simplified view of an antenna device 40 where this is illustrated. The antenna device 40 in this case comprises a group antenna realized by means of a number of parallel cavity waveguides. Three of these cavity waveguides 41,42,43 are shown in the Figure. An adjacent fourth cavity waveguide 44 is indicated with dashed lines. Each cavity waveguide has a longitudinal ridge 41*a*,42*a*, 43*a*. Further, the cavity waveguides are each provided with a number of slots, of which two slots 51 can be seen in the figure. As is indicated in the figure, the ridges of the cavity waveguides are filled on level with these slots 51. The slots are in this example are Z-formed, whereat they comprise a longer section of approximately 30 mm, which is perpendicular to the longitudinal direction of the cavity waveguides, and in each end of this longer section a shorter section of approximately 10 mm, which is oriented in the longitudinal direction of the cavity waveguides. Many other slot-forms are, however, possible.

Around each of the slots 51 in the cavity waveguides an electrically conducting, elastic sealing device 53 is arranged in a groove in the outer wall of the cavity waveguides. The sealing devices 53 comprise a set of short sealing elements which are arranged one after another and are adjusted to follow right outside the contours of the slots. In this example the distance between the outer contours of the slots and the sealing devices 53 is approximately 1 mm. The distance between two adjacent sealing elements is small in comparison to the wavelength of the microwave signals, such that the sealing devices 53 may be considered electrically sealed in the meaning that leakage of signal effect through the interspaces between separate sealing elements essentially can be totally ignored.

A strip-line card 45 is arranged across all of the cavity waveguides in the group antenna. This strip-line card 45, which in the figure is shown as severed in order to show the underlying cavity waveguides, is arranged to conduct the microwave signals to, and/or from, the cavity waveguides through said slots 51 in the cavity waveguides. Essentially straight above each of these slots 51, the strip-line card has a corresponding slot 49 in that one of the two earth planes which faces towards the cavity waveguides. These earth plane slots 49 have mainly the same form and extension as the slots 51 in the cavity waveguides. The slots 49 and 51 therefore form pairs of adjacent similar slots.

A set of through-plated holes 50 is symmetrically arranged in a rectangular form around each slot 49 in the strip-line card. These through-plated holes 50 connect the two earth planes of the strip-line card electrically. The distance between two adjacent holes is small in comparison to the microwave signal wavelength. Each set of through-plated holes act together with the two earth planes as a mode suppressor the extension of which is adapted to the microwave signal wavelength λ. Into each such mode suppressor, formed by through-plated holes, a strip-line conductor 48 leads, oriented in the longitudinal direction of the cavity waveguides, which strip-line conductor, after having transversed its respective slot 49, ends as an open stub conductor. The strip-line conductor 48 may, according to one point of view, be seen as a sond, a so-called probe, which propagates into the mode suppressor and there produces an electromagnetic wave, which is transferred via the slots 49 and 51 to the respective cavity waveguides.

Each cavity waveguide is fixed to the strip-line card 45 by means of a number of screws of which two screws 52 for each of the cavity waveguides 41, 42 and 43 are shown in this FIG. 4. By means of these screws, said strip-line card 45 is forced against the elastic sealing devices 53. Thereby, good electrical coupling is obtained through each sealing element in the sealing devices 53 between the strip-line-earth plane and the cavity waveguides. These sealing devices hereby is electrically sealed towards the environment so that the risk of leakage of signal power to the environment is minimized. At the same time, in the same way as in earlier described embodiments of the invention, a small cavity between the slots in each pair of slots if formed, where the cavity has a levelling effect. Through this, the demands for mechanical precision is decreased so that the tolerance towards the placement of the slots opposite to each other essentially can be increased in comparison to the case where the waveguides 41,42,43 would bear directly against the strip-line card 45.

On the strip-line card 45 a power distributing network is indicated by which signal effect is conducted to the strip-line conductor 48, which transfers the signal effect via said slots to the cavity waveguides. The power distribution net comprises a set of power distributors 46 in the form of Wilkinson-distributors, which distribute the incoming effect to two outgoing strip-line conductors. In this example, the effect is distributed in equal parts. The power distributing net further comprises a set of adaptation circuits 47. Such an adaptation circuit 47 is arranged for each pair of slots. The adaptation circuits 47 are, according to known technique per se, realized by means of a pair of stub conductors 54, the length and positions of which being adapted to give a good adaptation at the transitions.

The description of the antenna device 40 in this embodiment has been made from the point of view that the antenna device is used for sending, at which effect/power is transferred from the strip-line card 45 to the cavity waveguides. The antenna device 40, however, equally well is suited for receiving.

The strip-line card 45 is in this example manufactured in the traditional strip-line technique having two earth planes on each side of a substrate comprising a strip-line conductor. This is an advantageous embodiment since good power transfer to the cavity waveguides with small losses is possible using this technique. It would, however, also be possible to make the strip-line card in microstrip technique. Further, the power is fed to the whole antenna by means of one and the same strip-line card in this embodiment. It is of course possible, and when using large antennas possibly advisable, to use a set of strip-line cards arranged parallel to each other for the antenna connection, where each strip-line card feeds a number of slots in a number of the cavity waveguides comprised in the antenna. In this case, these strip-line cards can of course transfer power both to and from the cavity waveguides.

What is claimed is:

1. Device for power transmission of electromagnetic microwave energy between a first transmission conductor device and a second transmission conductor device wherein said first and second transmission conductor devices are arranged adjacent to each other and wherein the first transmission conductor device is bounded in a direction toward the second transmission conductor device by a first electrically conducting wall, and wherein said second transmission conductor device is bounded in a direction toward said first transmission conductor device by a second electrically conducting wall, wherein the power transmission is effected via a first radiation slot, having a size and shape, in said first electrically conducting wall, said device comprising:

a second radiation slot, having a size and shape, arranged in said second electrically conducting wall substantially opposite said first radiation slot, wherein said second radiation slot substantially exhibits the same size and shape as said first radiation slot; and an electrically conducting sealing means arranged in electrical contact with said first electrically conducting wall and said second electrically conducting wall surrounding said first and second radiation slots wherein the sealing means abuts said first and said second electrically conducting wall such that an electrically closed cavity is provided between said first and said second wall, through which cavity the microwave energy is transferred between said first and second transmission conductor devices, wherein said electrically conducting sealing means is formed of an elastic material.

2. The device of claim 1, wherein said first transmission conductor device is a first cavity waveguide comprising electrically conducting walls surrounding a first cavity.

3. The device of claim 2, wherein said first cavity waveguide is a ridge waveguide.

4. The device of claim 1, wherein said second transmission conductor device is a strip-line card.

5. The device of claim 4, wherein said first transmission conductor device is elongated, and wherein said strip-line card comprises a substrate, a respective ground plane, on each side of said substrate, wherein said ground plane comprises said second electrically conducting wall and said strip-line card further comprises an elongated central conductor arranged in the substrate, said conductor extending in a longitudinal direction of the first elongated transmission conductor device.

6. The device of claim 5, wherein the central conductor is arranged substantially opposite said second radiation slot.

7. The device of claim 5, wherein said strip-line card comprises a set of through-plated holes, whereby the ground planes are electrically connected at said set of through-plated holes, wherein said through-plated holes surround said second radiation slot.

8. The device of claim 1, wherein an elongation of the cavity is smaller than said first and second transmission conductor devices.

9. The device of claim 1, wherein said electrically closed cavity is bounded in a first dimension by said first and second electrically conducting walls and in a second and a third dimension by the electrically conducting sealing means.

10. The device of claim 9, wherein the sealing means surrounds said first and second radiation slots, substantially following contours of said first and second radiation slots, such that an elongation of the cavity in said second and said third dimensions is larger than said first and second radiation slots.

11. The device of claim 1, wherein the conducting sealing means comprises at least one electrically conducting sealing element.

12. The device of claim 1, wherein the electrically conducting sealing means abuts both the first and second electrically conducting walls substantially along a perimeter thereof.

13. The device of claim 1, wherein said first and second radiation slots are H-shaped, respectively.

14. The device of claim 1, wherein said elastic material of said electrically conducting sealing means is comprised of silicon rubber coated with silver-plated aluminum.

15. The device of claim 1, wherein said elastic material includes a conductive layer coating.

16. Antenna device for electromagnetic microwave energy comprising:

a first set of substantially similar cavity waveguides which are arranged substantially parallel and adjacent to each other, each cavity waveguide comprising electrically conducting walls surrounding a cavity, respectively, said cavity waveguides each, respectively, having a first set of slots on a front wall through which microwave energy is exchanged with surroundings of said cavity waveguides, wherein said cavity waveguides, respectively, are coupled to a second set of transmission conduction devices via a second set of slots each having a size and shape, respectively, in respective rear walls of said cavity waveguides, said second set of transmission conductor devices comprises respective strip-line cards, each comprising at least a first ground plane wherein said strip-line cards are delimited towards the cavity waveguides by said at least a first ground plane in such a manner that said at least a first ground plane is parallel to the rear walls of the cavity waveguides, a third set of slots, each having a size and a shape, respectively, arranged in each said at least a first ground plane, wherein each slot in said third set of slots, respectively, is arranged substantially opposite one of said slots in said second set of slots, whereby a set of slot pairs are provided, wherein the slots in said third set of slots substantially exhibit the same size and shape as the slots in said second set of slots, respectively, and an electrically conducting sealing means arranged in electrical contact surrounding each slot pair, respectively, wherein each of said sealing means abuts the rear wall of one of the cavity waveguides and against the ground plane of one of said strip-line cards in such a manner that for each slot pair, a respective substantially sealed cavity is provided between the respective strip-line card and the cavity waveguide, through which cavity microwave energy is transferred.

17. The antenna device of claim 16, wherein at least one of said cavity waveguides is a ridge waveguide.

18. The antenna device of claim 16, wherein said strip-line cards each comprise a substrate and ground plane on each side of said substrate, wherein each of said strip-line cards further comprises an elongated strip-line conductor arranged in said substrate, respectively, which adjoins said respective third slot and extends in a longitudinal direction of the cavity waveguides.

19. The antenna device of claim 18, wherein said strip-line conductors are each arranged essentially opposite on each of said third slots, respectively.

20. The antenna device of claim 18, wherein at least one said strip-line card comprises a set of through-plated holes for each pair of slots, whereby the strip-line ground planes are electrically connected to each other, wherein said through-plated holes are arranged around the slot pair, respectively, thereby counteracting coupling of signals between different sets of slots.

21. The antenna device of claim 16, wherein an elongation of the cavities is smaller than an elongation of the strip-line cards and an elongation of the cavity waveguides.

22. The antenna device of claim 16, wherein each cavity is bounded in a first dimension of the respective cavity waveguide wall and one of the strip-line ground planes, respectively and in a second and a third dimension of the respective sealing means.

23. The antenna device of claim 22, wherein each sealing means is arranged around the slot pairs, respectively, following contours of said slot pairs such that an elongation of each cavity in said second and said third dimensions is larger than an elongation of the respective slots of the slot pairs belonging to the cavity.

24. The antenna device of claim 14, wherein the cavity waveguides are elongated and that said respective first slots are substantially evenly spaced along the respective cavity waveguides and elongated in a longitudinal direction of the respective cavity waveguides.

25. The antenna device of claim 16, wherein said first set of cavity waveguides extends beyond said second set of transmission conductor devices.

26. The antenna device of claim 16, wherein a plurality of cavity waveguides are coupled to a common transmission conductor device.

27. The device of claim 14, wherein said electrically conducting sealing means is comprised of an elastic material.

28. The device of claim 27, wherein said elastic material includes a conductive layer coating.

29. The device of claim 27, wherein said elastic material of said electrically conducting sealing means is comprised of silicon rubber coated with silver-plated aluminum.

30. A device for power transmission of electromagnetic microwave energy between a first transmission conductor device and a second transmission conductor device wherein said first and second transmission conductor devices are arranged adjacent to each other and wherein the first transmission conductor device is bounded in a direction toward the second transmission conductor device by a first electrically conducting wall, and wherein said second transmission conductor device is bounded in a direction toward said first transmission conductor device by a second electrically conducting wall, wherein the power transmission is effected via a first radiation slot, having a size and shape, in said first electrically conducting wall, said device comprising:

a second radiation slot, having a size and shape, arranged in said second electrically conducting wall substantially opposite said first radiation slot, wherein said second radiation slot substantially exhibits the same size and shape as said first radiation slot; and an electrically conducting sealing means arranged in electrical contact with said first electrically conducting wall and said second electrically conducting wall surrounding said first and second radiation slots wherein the sealing means abuts said first and said second electrically conducting wall such that an electrically closed cavity is provided between said first and said second wall, through which cavity the microwave energy is transferred between said first and second transmission conductor devices, wherein said electrically closed cavity is bounded in a first dimension by said first and second electrically conducting walls and in a second and a third dimension by the electrically conducting sealing means, and wherein the sealing means surrounds said first and second radiation slots, substantially following contours of said first and second radiation slots, such that an elongation of the cavity in said second and said third dimensions is larger than said first and second radiation slots.

* * * * *